US006557328B1

(12) United States Patent
Stinnett et al.

(10) Patent No.: US 6,557,328 B1
(45) Date of Patent: May 6, 2003

(54) FENDER SHAPER FOR CORRECTING STIRRUP ORIENTATION

(76) Inventors: Rosemarie Stinnett, 880 W. Highland Dr., Camarillo, CA (US) 93010; Lee Stein, 880 W. Highland Dr., Camarillo, CA (US) 93010

( * ) Notice: Subject to any disclaimer, the term of this patent is extended or adjusted under 35 U.S.C. 154(b) by 0 days.

(21) Appl. No.: 10/134,738

(22) Filed: Apr. 30, 2002

(51) Int. Cl.[7] ..... B68C 3/00; B68C 1/16
(52) U.S. Cl. ..... 54/47; 54/46.1; D30/142
(58) Field of Search ..... 54/44.1, 1, 46.1, 54/47; D30/135, 142

(56) References Cited

U.S. PATENT DOCUMENTS

| | | | | | |
|---|---|---|---|---|---|
| 740,888 | A | * | 10/1903 | May | 54/47 |
| 956,649 | A | * | 5/1910 | Shepard | 54/46.1 |
| 2,978,855 | A | * | 4/1961 | Horst | 54/47 |
| 4,354,338 | A | * | 10/1982 | Martin | 54/47 |
| 5,598,687 | A | * | 2/1997 | Hester | 54/47 |
| 6,216,427 | B1 | * | 4/2001 | Cupp | 54/47 |

* cited by examiner

*Primary Examiner*—Charles T. Jordan
*Assistant Examiner*—Elizabeth Shaw
(74) *Attorney, Agent, or Firm*—J. E. McTaggart

(57) ABSTRACT

A fender shaper system for equestrian use, that can be easily added to a new or used saddle system, shapes the fenders optimally and holds the desired shape permanently, thus eliminating the conventional need to soak the fenders in water and reshape them repeatedly due to their inherent tendency to revert back toward the original flat shape unless kept stored in a special holder. The fender shaper system permanently ensures the correct free-hanging stirrup orientation that makes mounting easier and safer by avoiding any need to reach down and turn the stirrup manually, and also ensures riding comfort free of leg stress and fatigue from having to continuously counteract a tendency of the stirrups to hang at an incorrect orientation. The fender shaper is formed from sheet stainless steel bent into the shape of a right angle bracket with curvature. In a primary embodiment for leather fenders, the fender can be fastened to the fender shaper with a pair of ornamental screw fasteners and a retaining tab. The stirrup strap is retained against the front of the fender shaper by a retaining strap for correct free-hanging stirrup orientation. A secondary embodiment for fenders of the woven fabric type can be attached with self-adhesive disengagable fastening material such as Velcro.

8 Claims, 4 Drawing Sheets

FENDER SHAPER FOR CORRECTING STIRRUP ORIENTATION

FIELD OF THE INVENTION

The present invention relates to the field of horse riding equipment and more particularly it relates to metal fender shapers that can be readily added to the fenders of an existing saddle system for correcting the free-hanging orientation of the stirrups for ready insertion of the rider's feet without manual assistance and for avoiding riding discomfort and leg stress that can be caused by incorrect free-hanging stirrup orientation.

BACKGROUND OF THE INVENTION

The three dimensional view of FIG. 1 depicts a conventional Western style saddle system 10 mounted on a horse 12, shown in part, facing toward the left. The saddle system includes on each side a fender 14, typically made from a flat panel, about ⅛ inch thick, of quality leather with a tooled finish. Concealed beneath the fender 14, a stirrup strap 16, formed as an adjustable-length loop, is suspended securely from the main saddle structure at its upper end, and carries the stirrup 18 at its lower end, where it loops under a neck bolt (not visible) across the throat at the upper region of the stirrup 18. The lower portion of the stirrup strap 16 is typically covered by an extension tab configured in the fender 14 as shown. This tab passes through the stirrup 18 and extends part way up inside the fender 14 along with the stirrup strap 16 as shown, and the doubled lower loop is typically seized together by a buckled leather strap 20 known as a "hobble strap". The stirrup strap 16 is typically attached to a top region of the fender 14 with a pair of rivets which are normally concealed beneath a saddle skirt as indicated.

When the fender 14 is new and has not been shaped or even if it was once shaped and allowed to lose its shape, it is substantially flat and tends to lay flat against the horse's side; in this condition the free-hanging orientation of the stirrup 18 is substantially parallel to the horse's side as shown in FIG. 2. Thus a rider, on first mounting the horse, would have to reach down to at least the offside stirrup and manually turn it about 90 degrees for inserting the foot. Not only is this inconvenient, time-consuming and potentially dangerous upon first mounting, it is also distracting and uncomfortable for normal riding as it requires some effort from the rider to counteract the tendency to revert to the incorrect orientation.

DESCRIPTION OF KNOWN ART

To overcome the "flat fender" problem described above, it is customary to "break in" the fenders in a manner to set a curvature in the lower region so that the stirrups will free-hang in a more convenient orientation: commonly the fenders are soaked in water to overcome their original stiffness for forming the curvature in some form of shaping apparatus. When properly shaped, the stirrups hang much closer to the ideal orientation perpendicular to the horse's side; as an additional functional benefit the curvature introduced in the fender provides the rider with a degree of leg protection from the front. Furthermore the aesthetic appearance of fender shaping has become an important tradition.

However, it is an inherent property of the leather fender that, no matter how many times it is reshaped, each time it almost immediately starts losing this artificial shape and reverting toward its inherent flat shape unless specially stored in some kind of "set holder", sometimes referred to as "holders" or "setters". Such set holders are disclosed in U.S. Pat. Nos. 4,590,750, 3,827,215 and D289,453. In the absence of such set holders, the soaking and reshaping has to be repeated frequently. Not only is this inconvenient but it is potentially harmful to the condition and appearance of the leather. As the artificial fender shaping deteriorates, mounting becomes increasingly inconvenient and potentially dangerous, and riding comfort becomes increasingly impaired by stress on the legs due to increasing torque from the incorrect free-hanging stirrup orientation.

U.S. Pat. No. 4,354,338 to Martin discloses a FENDER BENDING ATTACHMENT having a first leg shaped as a U-shaped channel with a pair of opposed abrasive engagement surface that frictionally engage opposite sides of the fender along a portion of a lower edge thereof, and that extends as a narrow strip bent to form second leg, perpendicular to the first leg, extending across the front side of the bottom edge of the fender, and a third leg perpendicular to the second leg extending rearwardly. According to the abstract, "The third leg and a portion of the first leg actually rest on top of the stirrup . . . ".

Other approaches to the problem such as in U.S. Pat. No. 4,399,646 SAFETY STIRRUP and U.S. Pat. No. 5,704,198 STIRRUP STRAIGHTENER CONNECTOR propose introducing a 90 degree orientation mechanically immediately above the stirrup. This would imply that the fender would be allowed to remain flat, thus sacrificing the leg-protective function and valued aesthetic appearance of the shaped fender.

Existing art fails to address an unfulfilled need for a device that can be easily incorporated in an existing fender, that will shape the fender in the desired manner to provide optimal stirrup orientation, and that will positively hold the fender permanently in the desired optimal shape.

OBJECTS OF THE INVENTION

It is a primary object of the present invention to provide a solution to the widespread problem encountered by horseback riders, that when the fenders are new or have lost their artificial shaping and reverted back to their natural flat shape, upon mounting, getting the feet into the stirrups is problematic and usually requires manual assistance because the orientation of the stirrups in their initial free-hanging condition is inherently incorrect.

It is a further object to provide a simple device that can be readily added to existing regular riding gear to hold the fender properly shaped for correct free-hanging orientation of the stirrups substantially perpendicular to horse's side so that, upon mounting, the rider can easily insert the feet without need of manual assistance, and enjoy riding with enhanced comfort provided by the more ergonomic stirrup suspension.

It is a further object that the stirrup orientation correction device not contact the horse's body or interfere in any way with the functioning of other riding gear.

SUMMARY OF THE INVENTION

The present invention is a sheet metal fender shaper that can be easily attached to the fender of an existing saddle system and that will positively shape and retain the fender in an optimal manner that holds the stirrup in correct free-hanging orientation that enables easy insertion of the foot without requiring manual assistance, and that enhances riding comfort overall.

BRIEF DESCRIPTION OF THE DRAWINGS

The above and further objects, features and advantages of the present invention will be more fully understood from the following description taken with the accompanying drawings in which.

DETAILED DESCRIPTION

As described above, FIGS. 1 and 2 depict a saddle system 10 of known art with a flat fender 14 that causes the stirrup to hang in an incorrect orientation substantially parallel to the side of the horse 12.

Figure 1:
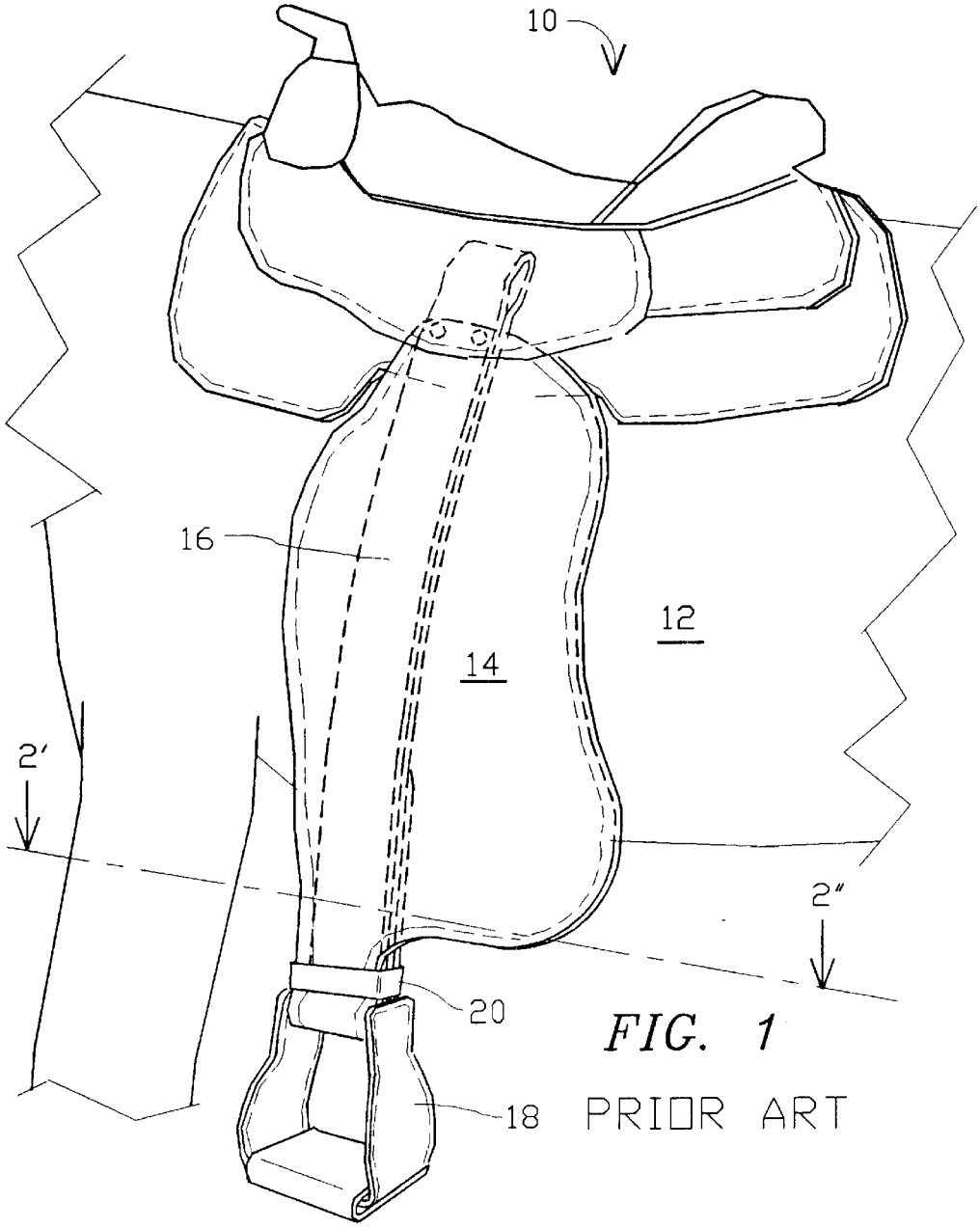
FIG. 1 PRIOR ART
FIG. 1 is a side elevational view of a conventional saddle system including an unshaped fender of known art.
Figure 2:
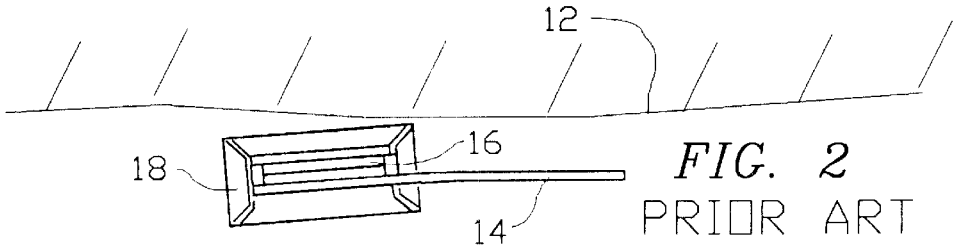
FIG. 2 PRIOR ART
FIG. 2 is a cross-sectional view of the fender, stirrup strap and stirrup of FIG. 1 taken through axis 2'–2".
Figure 3:
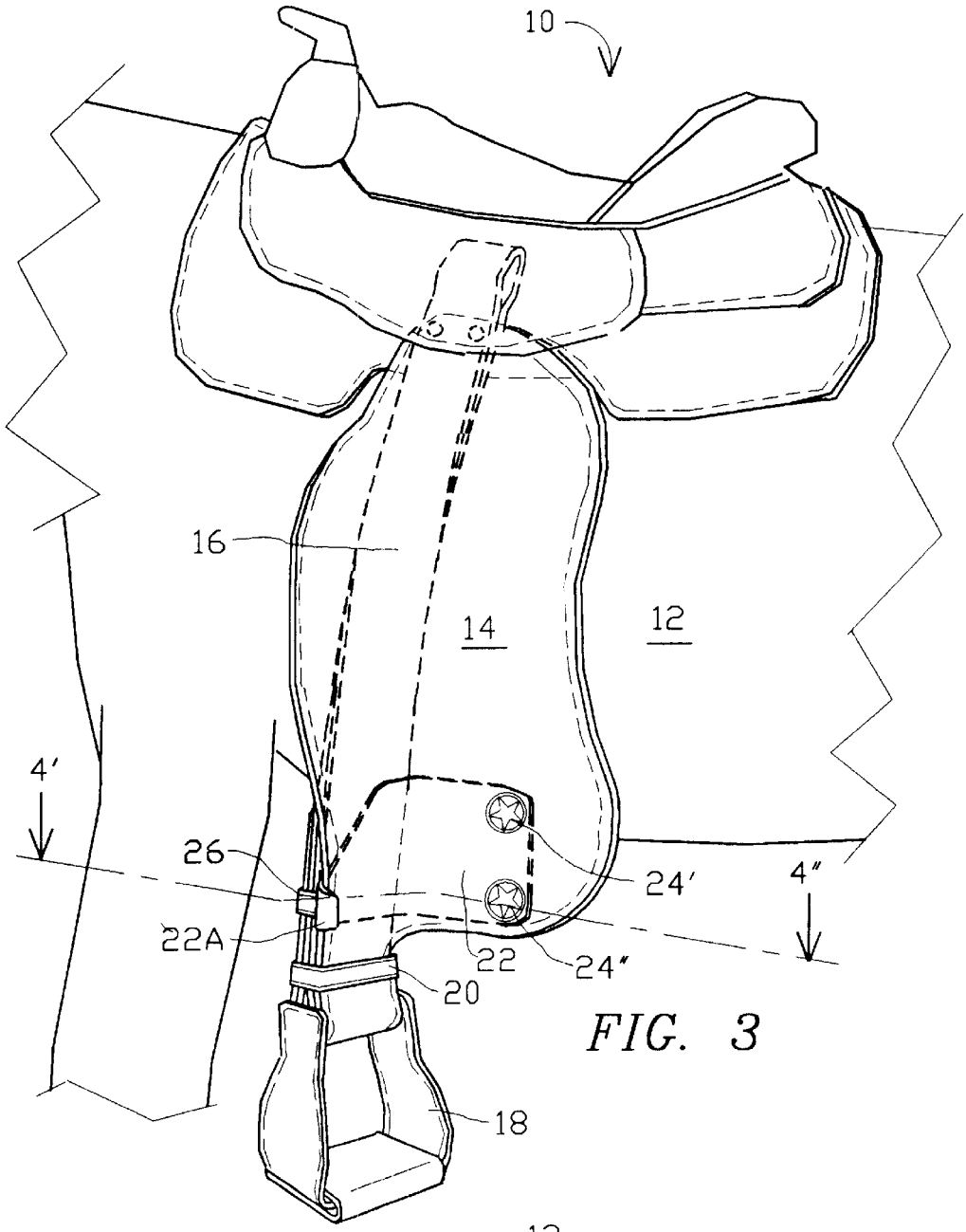
FIG. 3 is a side elevational view of a saddle system having a fender fitted with a fender shaper of the present invention in a first embodiment.

FIG. 3 is a side elevational view of a saddle system 10 as in FIG. 1, but wherein the fender 14 has been fitted with a fender shaper 22 in accordance with a the present invention in a first embodiment. Fender shaper 22 is made from a stiff plate of sheet metal, preferably stainless steel, and is bent with a curved corner to form two main portions that are made to be substantially perpendicular to each other. The rear portion of fender shaper 22 is fastened to a rear region of fender 14 by a pair of ornamental screw fastenings 24' and 24" preferably of the Chicago screw type having two parts that engage threadedly to provide an ornamental head on the exposed side, in this case shown as an encircled star, and a smooth truss head like that of a rivet on the reverse side. Secured together in this manner, the rear portions of the fender 14 and the fender shaper 22 and the top portion of the stirrup strap 16 being riveted to a mid-top region of the fender 14, all remain substantially parallel to the horse's side, while the bottom front region of the fender 14 is curved around to conform with the perpendicular portion of the fender shaper 22, where it is held by a channel tab 22A formed as shown at the outer extremity of fender shaper 22. Additional support and perpendicular shape retention are provided to fender 14 from the entire front portion of fender shaper 22. The lower portion of the stirrup strap is held against the lower front region of the fender 14 by a buckled leather retaining strap 26, surrounding the stirrup strap 16 and riveted onto the perpendicular front side of the fender shaper 22.

This accomplishment of correct stirrup orientation requires essentially a twist of about 90 degrees from top to bottom in both the stirrup strap 16 and a front portion of fender 14, with fender shaper 22 acting to oppose the natural tendency of leather to revert to the original flat condition.

Figure 4:
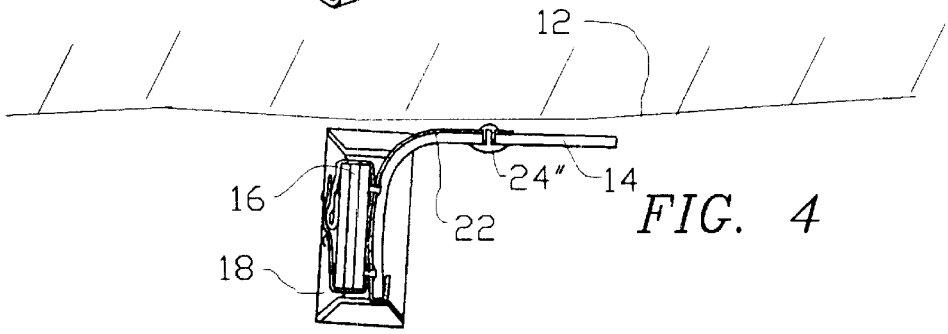
FIG. 4 is a cross-sectional view of the fender, stirrup strap and stirrup of FIG. 3 taken through axis 4'–4".
Figure 5:
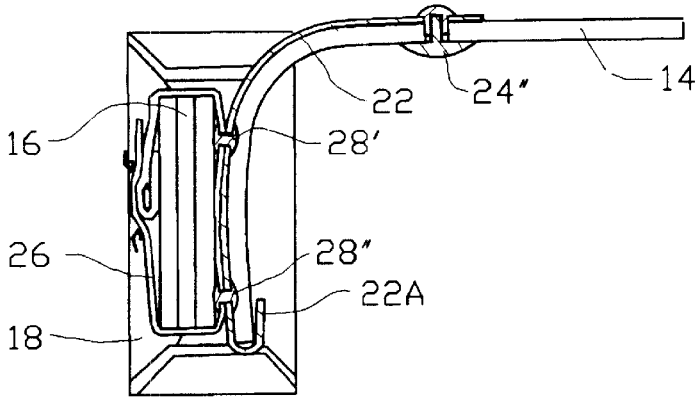
FIG. 5 is an enlarged view of the major portion of FIG. 4.

FIG. 4, a cross-sectional view taken looking down at axis 4'–4" of FIG. 3, shows bottom edge of fender 14 conforming to the two perpendicular portions defined by the curvature of fender shaper 22, so that the free-hanging orientation of the stirrup 18 and stirrup strap 16 are positively maintained in the favorable direction shown: substantially perpendicular to the horse 12, for easy insertion of the rider's foot and for comfortable riding FIG. 5 is an enlarged view of the major portion of FIG. 4 showing how the lower portion of fender 14 is held in conformity with the curved front portion of fender shaper 22 by the combination of attachment by the pair of ornamental fasteners, indicated by fastener 24" in this view, and the channel tab 22A, while the stirrup strap 16 is held against the fender shaper 22 by buckled retaining strap 26 which is attached to fender shaper 22 by two rivets 28' and 28". Thus the stirrup 18 is held perpendicular to the rear fore-and-aft portion of the fender shaper 22.

Figure 6:
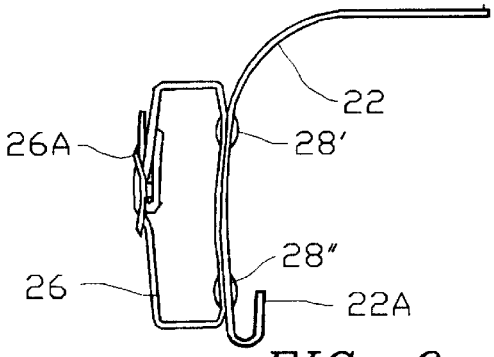
FIG. 6 is a top view of a fender shaper of the present invention from FIG. 4.

FIG. 6 is a top view of the fender shaper 22 as in FIG. 5 but removed from the fender, showing the formed channel tab 22A and retaining strap 26, with buckle 26A engaged, attached by rivets 28' and 28".

Figure 7:
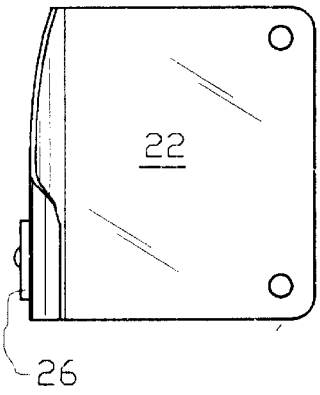
FIG. 7 is an elevational view of the fender shaper of FIG. 6.

FIG. 7 is an elevational view of the fender shaper of FIG. 6, showing the attached location of retaining strap 26, and showing two holes provided for fastening to the fender.

Figure 8:
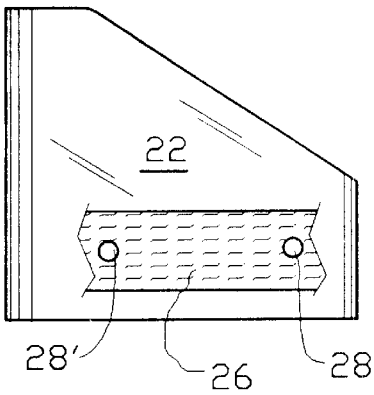
FIG. 8 is a left hand side view of the fender shaper of FIG. 7.

FIG. 8 is a left hand side view of the fender shaper of FIG. 7 showing the location of a portion of the retaining strap 26, fastened by rivets 28' and 28".

Figure 9:
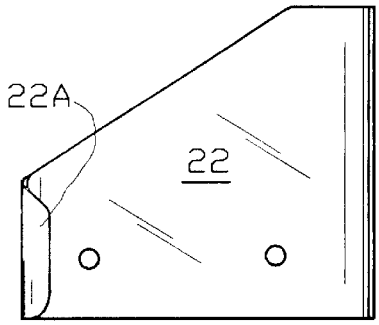
FIG. 9 is a right hand side view of the fender shaper of FIG. 6.

FIG. 9 is a right hand side view of the fender shaper of FIG. 6, showing the channel tab 22A and the opposite end of the rivets shown in FIG. 8.

Figure 10:
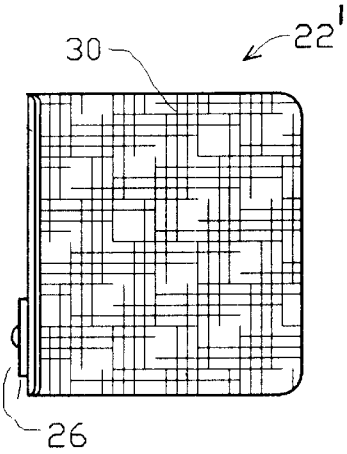
FIG. 10 is an elevational view of a fender shaper in a second embodiment of the present invention.

FIG. 10 is an elevational view of a fender shaper 22' in a second embodiment of the present invention directed to an alternative removable system for attachment to the fender, suited to lightweight saddles of the type in which the fender is made from woven fabric such as Cordura. This embodiment utilizes self-adhesive disengagable fastening fabric such as the well-known Velcro hook and loop type as an alternative to Chicago screws and the channel tab of the first embodiment (24', 24" and 22A respectively in FIG. 3) for securing the fender to the fender shaper.

For this second embodiment, as shown in FIG. 10, the fender shaper 22' is made to be substantially rectangular with rounded corners. The full surface seen in this view is covered with Velcro type fastening material 30 with self-adhesive backing by which the fender shaper 22' is attached to the fender.

Figure 11:
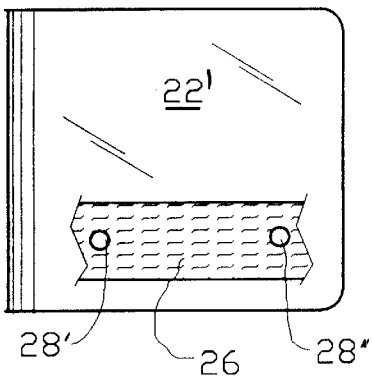
FIG. 11 is a left hand side view of the fender shaper of FIG. 10.

In FIG. 11, a left hand side view of the fender shaper 22' of FIG. 10, a portion of the leather retaining strap 26 is shown fastened by rivets 28' and 28" in the same manner as in the first embodiment shown in FIG. 8. As in FIG. 10, this profile is also substantially rectangular with rounded corners.

Figure 12:
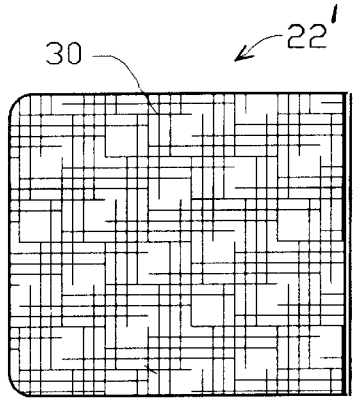
FIG. 12 is a right hand side view of the fender shaper of FIG. 10.

FIG. 12 is a right hand side view of the fender shaper 22' of FIG. 10. As in FIG. 10, the full viewable surface, approximately 3 inches by 4 inches, is covered with the Velcro type fastening material 30.

Figure 13:
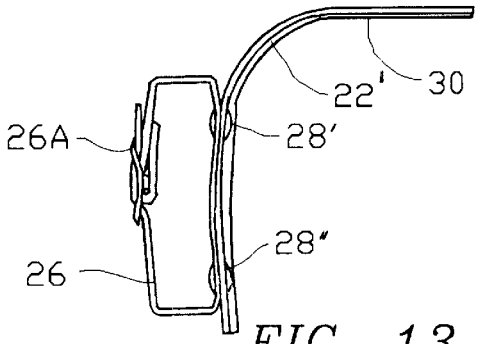
FIG. 13 is top view of the fender shaper of FIG. 10.

FIG. 13 is top view of the fender shaper 22' of FIG. 10 with an attached retaining strap 26 and its buckle 26A attached by rivets 28' and 28" as in the first embodiment. The entire opposite surface of fender shaper 22' is shown lined with the Velcro type fastening material 30.

Figure 14:
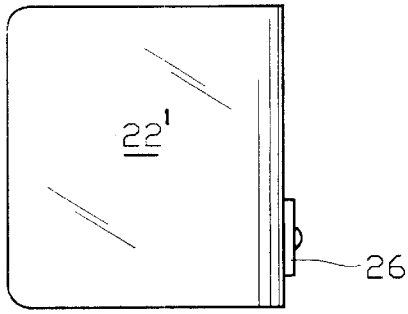
FIG. 14 depicts the fender shaper of FIG. 10 as viewed from the opposite side.

FIG. 14 depicts the fender shaper 22' of FIG. 10 as viewed from the opposite side; because of the use of the Velcro type fastening material 30, the two ornamental fasteners and the retaining channel tab of the first embodiment are eliminated. To deploy this fender shaper 22' in accordance with the second embodiment of the invention, a corresponding rectangle of fastening material of a type that will matingly engage the fastening material 30 (FIGS. 10, 12) is adhesively attached to the fender in the appropriate region (substantially as shown in FIG. 3). If the fastening material 30 is of a type such as Velcro that utilizes two complementary fastening surface types, e.g. hook and loop, then one such surface type would be applied to the fender shaper 22' while the other complementary type would be applied to the fender.

In either embodiment described above, the horse's body never comes in contact with the metal shaper, and there is no adverse effect introduced that would in any way tend to alarm the horse.

While the cambered shape shown in FIGS. 8 and 9 is believed optimal for fender shaper 22 of the first embodiment and the full rectangular shape shown in FIGS. 10 and 12 is believed to be optimal for fender shaper 22' of the second embodiment, the invention could be practiced with variations from these exact shapes.

As an option, instead of fastening of retaining strap 26 by rivets, e.g. 28' and 28" as shown in FIGS. 6, 8, 11 and 13, this fastening could be accomplished by configuring a pair of slots in the fender shaper in approximately the same locations as used for the rivets and allowing the strap 26 to loop through both slots and thus become captivated to the fender shaper.

The fender shaper of this invention could be practiced in other equivalent forms using alternative materials and fastening methods to accomplish the objective of establishing and maintaining optimal shape of the fender and retaining the desired optimal orientation of the free-hanging stirrup.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

I claim:

1. A fender shaping system, for deployment for correction of free-hanging stirrup orientation in an existing equestrian saddle system having a pair of inherently flat fenders and a pair of stirrup straps supporting a corresponding pair of stirrups, comprising a mirror-image pair of fender shapers each comprising:

a rigid main body generally shaped as a rectangular plate bent around a lateral axis in a central region thereof so as to form a first and a second portion disposed approximately perpendicular to each other;

fastening means for attaching the main body to a corresponding one of the fenders such that the first portion of the main body is made to conform to a major and generally rearward portion of the fender oriented generally in a longitudinal horizontal axis, while the remaining generally forward and lower minor portion of the fender is made to conform with the second portion of the main body, oriented generally in a lateral horizontal axis; and a flexible retaining strap, incorporated in the second portion of the main body of the fender shaper, made and arranged to retain a corresponding stirrup strap secured substantially flat against a front side of the second portion of the main body.

2. The fender shaping system as defined in claim 1 wherein said fastening means comprises:

a set of fasteners, selected from a group including rivets, eyelets and screws, disposed near a rear edge of the major rear portion of the fender, traversing and securing together the fender and the first portion of the main body of the fender shaper; and a constraining channel tab, formed by folding back an outer edge region of the second portion of the body of the fender shaper in a channel shape made and arranged to constrain an outer edge of the generally forward and lower minor portion of the fender in conformity with the second portion of the main body of the fender shaper.

3. The fender shaping system as defined in claim 1 wherein said fastening means comprises:

a layer of adhesive-backed releasable fastening material adhesively attached to an outer side of the main body of the fender shaper; and a corresponding layer of adhesive-backed releasable fastening material, of a type functionally complementary to that attached to the main body, adhesively attached to the fender on an outward-facing surface of a generally lower portion thereof, placed in releasable engagement with the layer of adhesive-backed releasable fastening material adhesively attached to the outer side of the main body of the fender shaper.

4. The fender shaping system as defined in claim 1 wherein the flexible retaining strap is located entirely on the front side of the second portion of the main body and attached thereto by a pair of fastening hardware items selected from a group including rivets and eyelets.

5. The fender shaping system as defined in claim 1 wherein the flexible retaining strap is captivated to the second portion of the main body by looping through a pair of elongated slots configured in the second portion of the main body.

6. The fender shaping system as defined in claim 1 wherein:

said fastening means comprises a layer of adhesive-backed releasable fastening material adhesively attached to an outer side of the main body of the fender shaper, and a corresponding layer of adhesive-backed releasable fastening material of functionally complementary type, adhesively attached to the fender on an outward-facing surface of a generally lower portion thereof, placed in releasable engagement with the layer of adhesive-backed releasable fastening material adhesively attached to the outer side of the main body of the fender shaper; and said stirrup strap retaining means comprises a flexible retaining strap, located on and affixed to the front side of the second portion of the main body of the fender shaper, made and arranged to retain the corresponding stirrup strap secured substantially flat against the front side of the second portion of the main body.

7. The fender shaping system as defined in claim 1 wherein:

said fastening means comprises a plurality of ornamental headed threaded fastening devices disposed near a rear edge of the major rear portion of the fender, traversing and securing together the fender and the first portion of the main body of the fender shaper, and a constraining channel tab, formed as a channel by folding back a tab at an outer edge region of the second portion of the body of the fender shaper, made and arranged to constrain an outer edge of the generally forward minor portion of the fender in a manner to provide conformity between the second portion of the main body of the fender shaper and a corresponding region of the fender.

8. A method of modifying an existing equestrian saddle system so as to permanently correct free-hanging stirrup orientation, the saddle system having a pair of inherently flat fenders and a pair of stirrup straps supporting a corresponding pair of stirrups that inherently tend to free-hang parallel to a body of an associated horse, comprising the steps of:

fashioning from stainless steel sheet metal a mirror-image pair of fender shaper main bodies each formed by centrally bending a generally rectangular-shaped plate in a central region thereof so as to form a first and a second portion disposed approximately perpendicular to each other;

incorporating in the second portion of the main body of each fender shaper a flexible retaining strap made and arranged to retain each corresponding stirrup strap secured substantially flat against a front side of the second portion of the corresponding main body; and attaching each fender shaper to a corresponding one of the fenders such that a major and generally rearward portion of the fender is made to conform to the first portion of the main body that is oriented generally in a longitudinal horizontal axis, while a remaining generally forward and lower minor portion of the fender is made to conform with the second portion of the main body that is oriented generally in a lateral horizontal axis.

* * * * *